United States Patent [19]

Calandra, Jr.

[11] 4,419,805

[45] Dec. 13, 1983

[54] METHOD FOR COMBINING RESIN BONDING AND MECHANICAL ANCHORING OF A BOLT IN A ROCK FORMATION

[75] Inventor: Frank Calandra, Jr., Johnstown, Pa.

[73] Assignee: Jennmar Corporation, Cresson, Pa.

[21] Appl. No.: 209,134

[22] Filed: Nov. 21, 1980

[51] Int. Cl.[3] ..... B23P 25/00

[52] U.S. Cl. ..... 29/458; 29/469.5; 29/522 R; 29/526 R; 405/259; 411/39

[58] Field of Search ..... 29/522 R, 526 R, 458, 29/460; 405/259, 260, 261; 411/39

[56] References Cited

U.S. PATENT DOCUMENTS

| | | | |
|---|---|---|---|
| 3,324,662 | 6/1967 | McLean | 61/35 |
| 3,394,527 | 7/1968 | McLean | 52/741 |
| 3,474,898 | 10/1969 | Montgomery | 405/261 X |
| 3,702,060 | 11/1972 | Cumming | 61/45 B |
| 3,877,235 | 4/1975 | Hill | 61/45 B |
| 3,940,941 | 3/1976 | Libert et al. | 61/45 B |
| 4,023,373 | 5/1977 | Hipkins | 61/45 B |
| 4,051,683 | 10/1977 | Koval | 61/45 B |
| 4,122,681 | 10/1978 | Vass et al. | 405/261 |
| 4,160,614 | 7/1979 | Koval | 405/259 |
| 4,162,133 | 7/1979 | Clark et al. | 405/258 |
| 4,192,631 | 3/1980 | Vass | 405/261 |
| 4,193,715 | 3/1980 | Vass | 405/261 |
| 4,194,858 | 3/1980 | Evans | 405/259 |

OTHER PUBLICATIONS

"Interior Rock Reinforcement Fixtures", presented at the 21st U.S. Symposium on Rock Mechanics, University of Missouri-Rolla, Apr. 1980, by Dr. James J. Scott.

"Resin Anchored Tensioned Bolting", in *Coal Age*, pp. 127 and 128, Jun. 1980.

"Shell Lock System", 1978 Sales Brochure published by Frazer & Jones, Division of the Eastern Company, Syracuse, New York.

"Pattin's Tensionable Resin Roof Bolt—A Better Resin Anchor Support System", a Sales Brochure published by Pattin Mfg. Co., a Division of the Eastern Company, Syracuse, New York.

Advertisement appearing in *Mining Congress Journal*, published by Pattin Mfg. Co., 1310 Green St., Marietta, Ohio 45750.

*Primary Examiner*—Wayne L. Shedd

*Attorney, Agent, or Firm*—Stanley J. Price, Jr.; John M. Adams

[57] ABSTRACT

A mechanical anchor including an expansion shell and a camming plug positioned in the shell is threaded onto the end of a mine roof bolt. A roof support plate is carried on the opposite end of the bolt. The mechanical anchor is inserted in a bore hole drilled in a rock formation with one or more resin cartridges advanced by upward movement of the bolt to the end of the bore hole. The cartridge is ruptured by upward thrust and rotation of the bolt to release the resin components for mixing. A stop device extending through the plug abuts the end of the bolt to prevent axial movement of the plug on the bolt when the bolt is rotated in a preselected direction to mix the resin components before the shell is expanded. Rotation of the bolt continues without expansion of the shell for a period of time to permit formation of a curable resin mixture. As the resin mixture begins to harden rotation of the shell and plug is resisted until the stop device is displaced permitting relative rotation between the plug and the bolt. The plug nonrotatably moves down the bolt upon continued rotation of the bolt in the same preselected direction to expand the shell into engagement with the wall of the bore hole before the resin mixture cures. The cured resin bonds the bolt and expanded shell to the rock formation to resist slippage of the expanded shell and maintain the bolt in tension.

8 Claims, 11 Drawing Figures

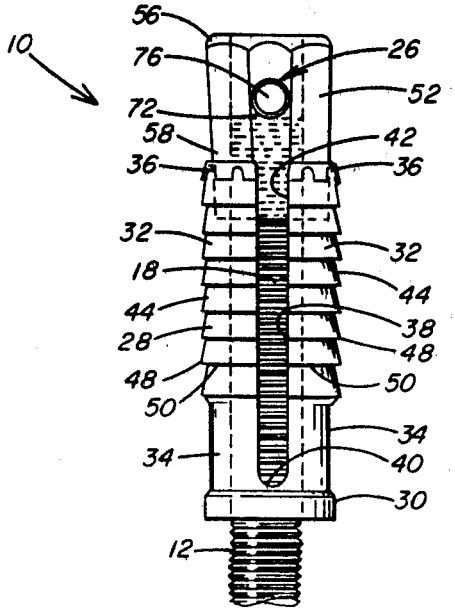
FIG. 1
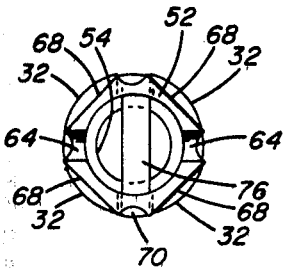
FIG. 2
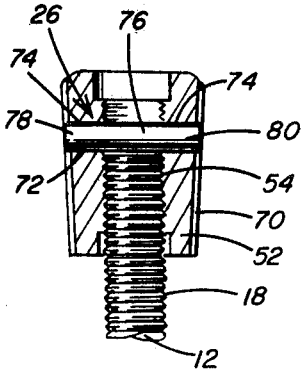
FIG. 4
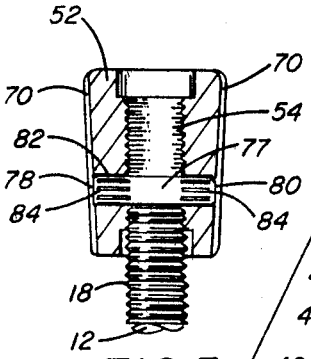
FIG. 5
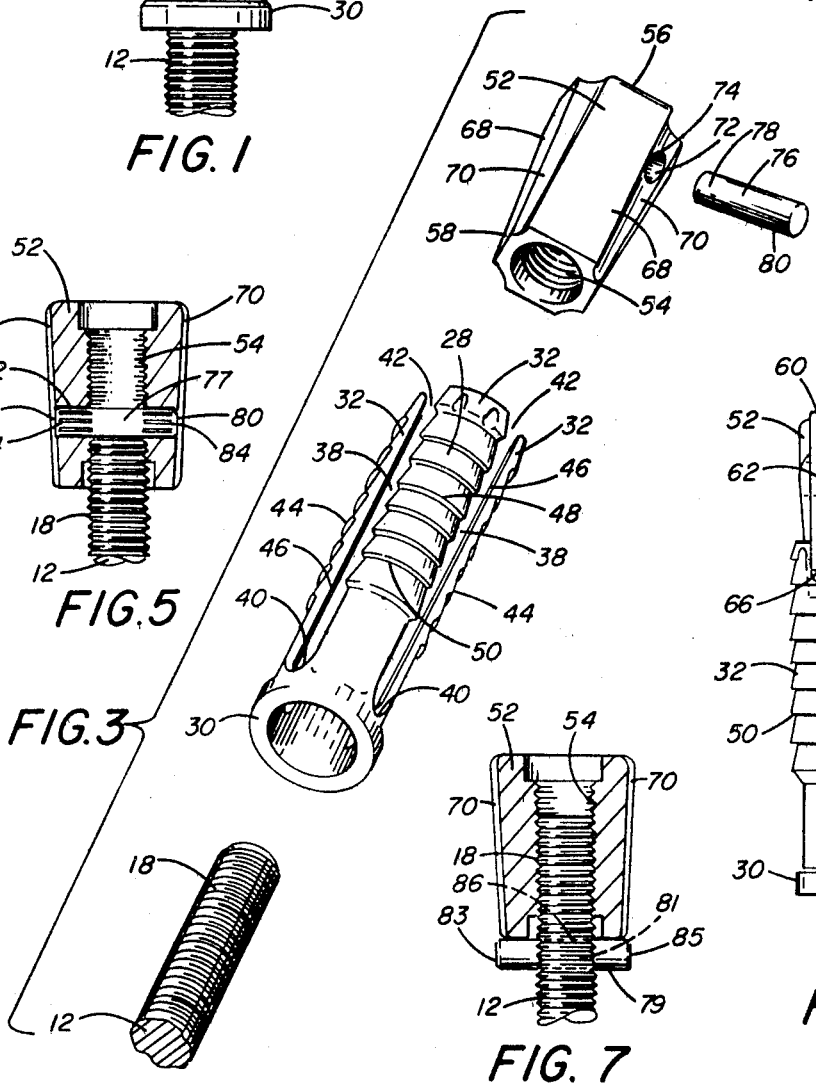
FIG. 3
FIG. 7
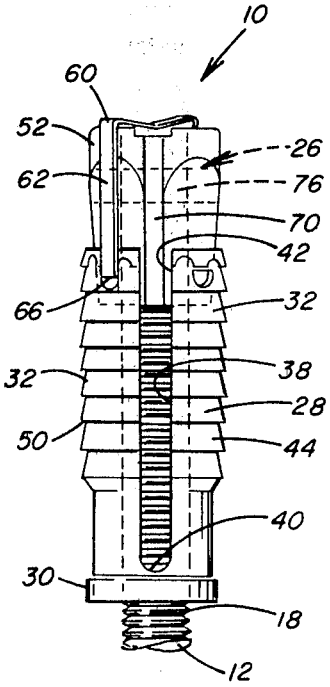
FIG. 6

METHOD FOR COMBINING RESIN BONDING AND MECHANICAL ANCHORING OF A BOLT IN A ROCK FORMATION

BACKGROUND OF THE INVENTION

1. Field of the Invention

This invention relates to a method and apparatus for combining resin bonding and mechanical anchoring of a bolt in a rock formation and more particularly to an expansion shell assembly adapted for use with bonding material where mixing of the bonding material components and expansion of the shell take place upon continuous rotation of the bolt in one rotational direction.

2. Description of the Prior Art

It is well known in the art of mine roof support to tension bolts anchored in bore holes drilled in the mine roof to reinforce the unsupported rock formation above the roof. Conventionally a hole is drilled through the roof into the rock formation. The end of the bolt in the rock formation is anchored by either engagement of an expansion shell on the end of the bolt with the rock formation or adhesively bonding the bolt by a thermosetting resin to the rock formation surrounding the bore hole. The resin also penetrates into the surrounding rock formation to adhesively unite the rock strata and to firmly hold the bolt in position in the bore hole. The resin mixture fills the annulus between the bore hole wall and the rod along a substantial length of the rod.

U.S. Pat. Nos. 3,324,662 and 3,394,527 disclose adhesively bonding a rod positioned in a hole drilled in a rock formation by a thermosetting polyester resin composition having thixotropic properties. It is well known that a bolt which is adhesively bonded in a bore hole can not be tensioned; on the other hand, a bolt mechanically anchored in a mine roof is capable of being tensioned but the contact of the roof bolt with the rock formation is confined to engagement of the expanded shell with the bore hole wall. Also, it is well known that deterioration of the rock formation surrounding the expanded shell reduces the contact area between the shell and the rock formation. Consequently the expanded shell slips and the tension on the bolt decreases, thereby reducing the roof support. Slippage of a tensioned mechanical roof bolt occurs most commonly in rock formations, such as shale, sandstone, mudstone, and the like.

In an attempt to resolve the disadvantages of anchoring by resin bonding or anchoring by expansion shells various types of mine roof support systems have been developed that combine mechanical anchoring and resin anchoring. The two systems have been combined by threading a bolt into a separate member such as a nut or coupling which is attached to a "rebar" anchored in the bore hole by a resin. A bolt with a plate held against the surface of the mine roof surrounding the bore hole is threaded into the separate member. Tightening the bolt places the bolt under tension.

U.S. Pat. No. 3,702,060 discloses an expansion shell assembly that includes a resin container which is fixed to the end of an expander positioned within an expansion shell. The container is ruptured after the shell begins to expand. Rotation of the bolt mixes the resin components, and the resin mixture surrounds the shell to embed the shell in the cured resin to bond the shell to the rock strata. When the resin is fully cured, a nut on the end of the bolt opposite a roof plate on the bolt is rotated to bring the roof plate to its fully seated position against the mine roof to fully tension the bolt.

Combining bolt tensioning and resin bonding of a mine roof bolt bolt in the bore hole is disclosed in U.S. Pat. Nos. 3,877,235 and 4,051,683. The devices disclosed in these patents utilize an internally threaded member such as a nut or coupling which is connected at one end to a "rebar" anchored within the bore hole by the mixed and cured resin. A bolt is then connected to the other end of the nut or coupling and includes a bearing or roof plate advanced into abutting relation with the mine roof. A stop means provided in the coupling limits axial advancement of the bolt into the coupling to prevent relative rotation of the coupling and the bolt as the assembly is rotated to break the resin cartridge and mix the resin components. When the resin cures the "rebar" above the coupling is adhesively bonded to the rock formation. Thereafter rotation of the bolt in the coupling fractures the stop means to permit the bolt to move upwardly in the bore hole so that sufficient torque is applied to the bolt to tension the bolt.

Similar devices which utilize a rod anchored within the drill hole by resin bonding and connected to a bolt by a coupling with a stop device to restrain relative rotation between the members of the assembly until the resin hardens so that the bolt can be tensioned are disclosed in U.S. Pat. Nos. 4,122,681 and 4,192,631. These devices rely upon the bonding of the elongated rod to the rock formation by the resin mixture. They do not utilize a mechanical anchor.

U.S. Pat. Nos. 4,160,614 and 4,162,133 disclose a mechanical anchor in combination with resin bonding of the bolt and the rock formation. Rotation of the bolt with the mechanical anchor attached to the end thereof in a first direction effects mixing of the resin components of a ruptured cartridge. An anti-rotation device prevents relative rotation between the camming plug and the bolt so that the plug is not threaded off the end of the bolt during mixing of the resin components. With this arrangement the resin components are thoroughly mixed before the shell is expanded. After a period of time sufficient for mixing the resin and before the resin hardens direction of rotation of the bolt is reversed to disengage the anti-rotation device. The camming plug is then free to advance downwardly on the bolt and expand the shell into gripping engagement with the wall of the bore hole.

The point anchor resin roof bolt support system utilizes the concept of anchoring a reinforcing rod in a mine roof by resin bonding and tensioning the bolt. The rod is anchored at its upper end in the bore hole by resin. A nut is positioned on the threaded end of the rod that emerges from the bolt hole and abuts a roof plate positioned in contact with the mine roof. The end of the rod at the nut is rotated to effect mixing of the resin. Rotation is terminated for a period of 30 to 60 seconds while the resin mixture cures. After the resin is set, then the bolt is rotated at a preselected torque to tension the bolt.

While it has been suggested by the prior art systems to anchor a roof bolt in a bore hole by combination resin bonding and bolt tensioning where mechanical anchors have been used it has not been possible to mix the resin and set the anchor by continuous rotation of the bolt in one direction. With the known systems the bolt must be rotated in a first direction to mix the resin while preventing expansion of the shell. When the mixed resin has begun to cure, then the direction of rotation of the bolt is reversed to expand the shell and set the anchor. Consequently careful attention must be given to rotating the bolt in the proper direction to mix the resin before the shell is set and not expand the shell before the resin is mixed. Furthermore when the bolt is rotated in the direction to effect mixing of the resin, necessary means must be provided to prevent threading the expander plug off the end of the bolt.

Therefore there is need in the system of combining resin bonding and mechanical anchoring of a bolt in a rock formation to provide a roof bolt anchor assembly that permits continuous rotation of a roof bolt in a single rotational direction to carry out both the operations of mixing the resin and expanding the shell.

SUMMARY OF THE INVENTION

In accordance with the present invention there is provided an expansion shell assembly for anchoring a bolt in a bore hole that includes a camming plug threadedly engaged to the end of the bolt for axial movement thereon. An expandable shell has a plurality of longitudinally extending fingers spaced from one another. The fingers each have an inner surface and an outer surface. A portion of the inner surface abuts the camming plug and the outer surface is adapted to engage the wall of the bore hole. Stop means associated with the camming plug prevents axial movement of the camming plug on the bolt upon rotation of the bolt in a preselected direction. The stop means is arranged to be displaced by the bolt upon continued rotation of the bolt in the preselected direction when a torque in access of a predetermined torque is applied to the bolt. The camming plug is then movable upon displacement of the stop means to expand the fingers to anchor the bolt in the bore hole.

Prior to insertion of the expansion shell assembly and the bolt in the bore hole a suitable bonding material, such as an adhesive resin material, packaged in a breakable cartridge, is inserted in the bore hole. The cartridge is advanced to the blind end of the bore hole by upward extension of the bolt with the expandable shell assembly attached to the bolt. Further upward advancement of the bolt fractures the cartridge, and thereafter the bolt together with the expansion shell assembly are rotated in a preselected direction to begin mixing the components of the adhesive material that were separated within the cartridge. Rotation of the bolt agitates the components to interact and form a curable adhesive mixture.

The stop means in one embodiment includes a shearable pin extending through a bore of the camming plug. End portions of the pin are retained in aligned bores of the camming plug. The pin passes transversely through the bore of the plug that receives the threaded end of the bolt. The end of the bolt abuts the pin to prevent initial downward axial movement of the plug on the bolt during rotation of the bolt to effect mixing of the adhesive components.

With the camming plug being restrained from downward movement on the bolt there is no relative rotation between the camming plug and the bolt. Thus the bolt, camming plug, and shell rotate as a single unit to effect mixing of the adhesive components in the bore hole. The curable mixture flows downwardly into contact with the shell and camming plug and fills the voids between the shell and the wall of the bore hole. The presence of the shear pin prevents downward movement of the camming plug on the bolt for the period of time required to complete mixing of the resin components. For a quick setting-type of adhesive material expansion of the shell is delayed for about 20 to 30 seconds to permit complete mixing of the adhesive components before the shell is expanded.

As the adhesive mixture begins to harden around the shell and the camming plug, the mixture exerts a force upon the shell and camming plug resisting rotation of the shell and plug. When the torque applied to the bolt exceeds a predetermined torque the anti-rotation forces exerted by the curing adhesive material exceed the material strength of the pin and the pin fractures. The plug is then free to advance downwardly on the bolt upon continued rotation of the bolt in the same direction for mixing to expand the fingers of the shell outwardly to grip the bore hole wall.

Expansion of the shell occurs after a preselected time period of continued rotation of the bolt in one rotational direction. Thus the bolt is rotated in a single direction to effect both mixing of the adhesive material and expansion of the bolt. This arrangement eliminates the need for reversing the direction of rotation of the bolt to expand the shell after the adhesive material is mixed.

For an adhesive material of the quick setting resin-type, the mixed resin begins to harden within 20 seconds after rupture of the cartridge. The stop means in the embodiment of a shearable pin is constructed of a preselected material and has a preselected cross sectional area to control the material strength of the pin. Thus the pin is operable to fracture when the mixing stage is complete and before the resin mixture hardens. This assures that the shell will expand before the resin cures and after the resin is completely mixed. For a selected resin system the pin is designed to fracture or shear in the bore of the camming plug when the torque applied to the bolt exceeds a predetermined torque. Preferably, the predetermined torque required to shear the pin is not reached until after, for example, the bolt is rotated for 20 to 30 seconds, i.e., the period of time required for mixing the resin components.

The stop means in one embodiment includes a pin fabricated of aluminum and having a preselected diameter. In another embodiment the stop means includes a steel pin having a length and diameter differing from that of the aluminum pin because of the difference in material strength of aluminum and steel. Further the location of the pin relative to the plug is selective, i.e. it can be retained in a selected axial position in the plug and abutting the end of the bolt or it can be retained in the bolt only and abutting the bottom of the plug. In each case by selecting the material composition and size of the pin, as well as, the position of the pin, the fracturing or shearing of the pin is controlable to meet the specifications of the resin system utilized. Thus a stop means is provided to permit mixing of the resin system for the period of time required for the selected resin system used before the shell is expanded upon continuous rotation of the bolt in one direction.

Further in accordance with the present invention there is provided a method of anchoring a bolt in a bore hole that includes the steps of threadedly engaging a camming plug to the end of the bolt for axial movement thereon. An expandable shell having a plurality of longitudinally extending fingers is positioned in surrounding relation with the camming plug on the bolt. Axial movement of the camming plug on the bolt is prevented by a stop means associated with the bolt upon rotation of the bolt in a preselected rotational direction. The stop means is displaced by the bolt as the bolt continues to rotate in said preselected rotational direction when a torque in excess of a predetermined torque is applied to the bolt. Thereafter the camming plug is moved on the bolt upon displacement of the stop means to expand the fingers to anchor the bolt in the bore hole.

Accordingly, the principal object of the present invention is to provide a method and apparatus for combining resin bonding and mechanical anchoring of a mine roof bolt in a rock formation by an expansion shell assembly provided with stop means that restrains expansion of the shell as the bolt is rotated in a preselected direction and then when a torque in excess of a predetermined torque is applied to the bolt the stop means is displaced to permit expansion of the shell.

Another object of the present invention is to provide a mechanical anchor for a mine roof bolt that is also adhesively bonded within a bore hole where the bolt is continuously rotated in a preselected direction to permit the sequential operations of mixing the resin material and thereafter expanding the shell after the resin is mixed but before it is cured to engage the wall of the bore hole.

A further object of the present invention is to provide a stop device associated with an expandable shell assembly that is operable to restrain the expansion of the shell for a period of time required to permit mixing of resin components in a bore hole where expansion of the shell is delayed until a preselected torque is applied to the bolt and after the resin is mixed but before the resin is cured.

These and other objects of the present invention will be more completely disclosed and described in the following specification, the accompanying drawings, and the appended claims.

BRIEF DESCRIPTION OF THE DRAWINGS

FIG. 1 is a fragmentary enlarged view in side elevation of an expansion shell assembly positioned on the threaded end of an elongated bolt, illustrating a stop device carried by a camming plug and engaging the end of the bolt for restraining movement of the plug on the bolt.

FIG. 2 is a top plan view of the expansion shell assembly shown in FIG. 1, illustrating the stop device in the form of a shearable pin extending through the bolt and having end portions retained in the camming plug.

FIG. 3 is a fragmentary exploded view of the expansion shell assembly of the present invention, illustrating the shearable pin which is retained in a bore of the camming plug and arranged to abut the end of the bolt.

FIG. 4 is a fragmentary sectional view in side elevation of the camming plug positioned on the bolt with the shell removed, illustrating the shearable pin extending through the camming plug and abutting the end of the bolt.

FIG. 5 is a view similar to FIG. 4, illustrating the pin in a lower position in the camming plug and provided with parallel grooves on the opposite ends of the pin to control shearing of the pin.

FIG. 6 is a view similar to FIG. 1, illustrating the stop device used with a bail-type expansion shell assembly.

FIG. 7 is a view similar to FIGS. 4 and 5 illustrating the shearable pin extending through the bolt only and positioned in abutting relation with the lower end of the camming plug.

DESCRIPTION OF THE PREFERRED EMBODIMENTS

Figures 8, 9, 10, 11:
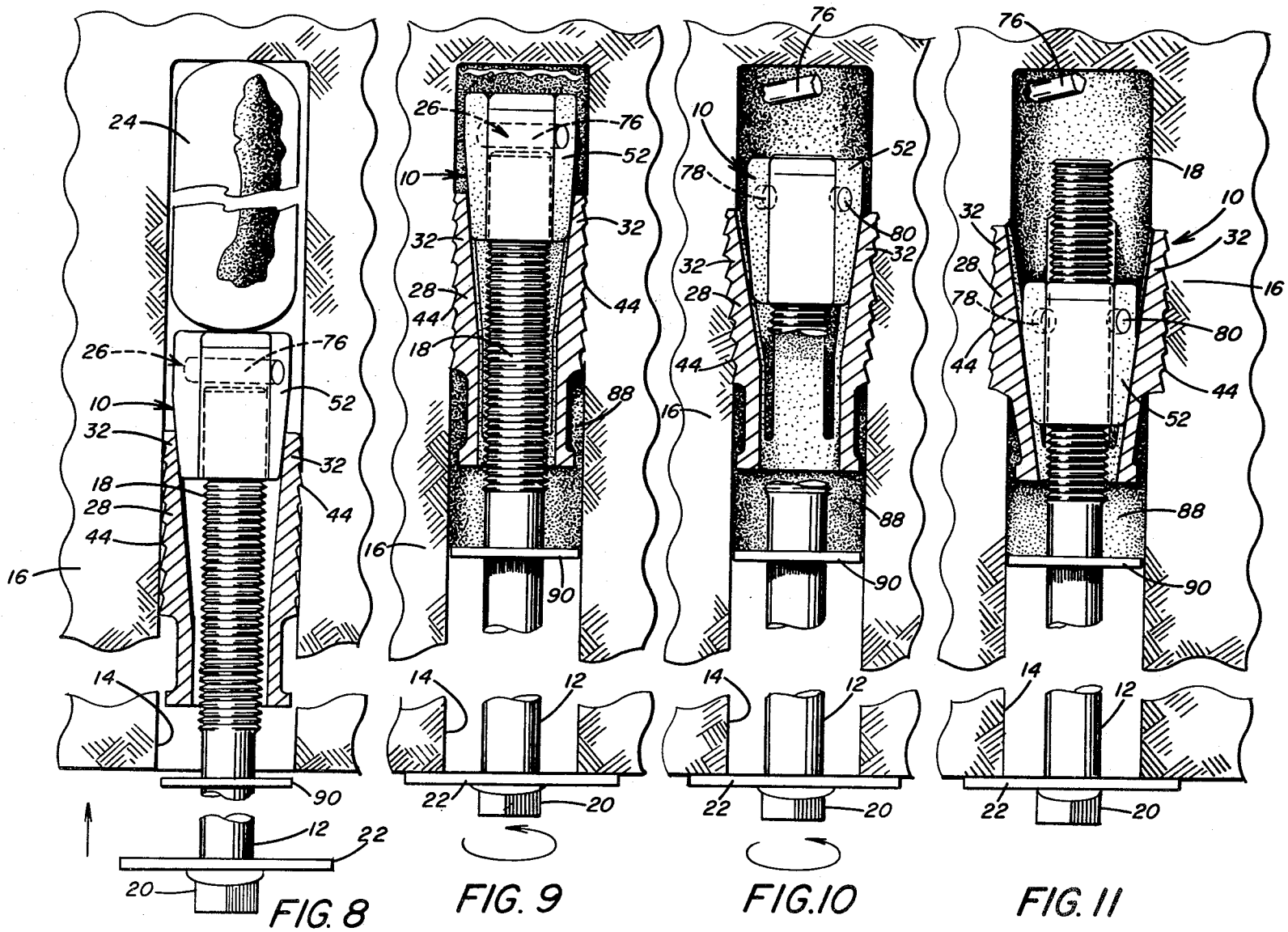
FIG. 8 is a side elevation partially in section of the first step in the method of installing the roof bolt in the bore hole, illustrating a resin cartridge in position at the end of the bore hole for rupture by the expansion shell assembly of the present invention.
FIG. 9 is a view similar to FIG. 8, illustrating mixing of the components of the ruptured cartridge by rotation of the bolt with the stop device restraining downward movement of the plug during mixing.
FIG. 10 is a view similar to FIGS. 8 and 9, illustrating a further step of continuing rotation of the bolt in the same direction to fracture the stop device after the mixing step to permit the plug to advance downwardly on the bolt and expand the shell.
FIG. 11 is a view further illustrating the method of the present invention where the plug is advanced downward on the bolt to fully expand the shell fingers into engagement with the wall bore hole with the cured and hardened resin surrounding and embedding the expanded shell.

Referring to the drawings and particularly to FIGS. 1–3 there is illustrated an expansion shell assembly generally designated by the numeral 10 for securing a bolt 12 in a bore hole 14 drilled in a rock formation 16 (illustrated in FIGS. 8–11) to support the rock formation 16 that overlies an underground excavation, a mine passageway, or the like. The bolt 12 has a threaded end portion 18 which is positioned in the upper blind end of the bore hole 14. The bore hole 14 is drilled to a preselected depth into the rock formation 16 as determined by the load bearing properties to be provided by the expansion shell assembly 10 and the bolt 12.

The bolt 12 has an enlarged opposite end portion 20 as seen in FIGS. 8–11 which extends from the open end of the bore hole 14. A roof or bearing plate 22 is retained by the bolt enlarged end portion 20 on the end of the bolt 12. Further in accordance with the present invention a breakable cartridge 24 containing a conventional two component bonding material, such as disclosed in U.S. Pat. Nos. 3,324,662 nd 3,394,527 is initially inserted in the bore hole 14 and advanced to the blind end of the bore hole 14, as shown in FIG. 8, by upward advancement of the bolt 12 in the bore hole 14. Once the cartridge 24 is ruptured and the components thereof are mixed by rotation of the bolt 12 in a preselected direction, a stop device generally designated by the numeral 26 restrains expansion of the shell assembly 10 until the roof plate 22 is in abutting relation with the surface of the rock formation 16 and the adhesive components are mixed.

The bolt is continuously rotated in the same preselected direction for a period of time sufficient to complete mixing of the components of the bonding material. The stop device 26 prevents expansion of the shell assembly 10 during the mixing stage. The bolt continues to rotate in the same initial direction. When the torque applied to the bolt exceeds a predetermined torque, as determined by the time for mixing the bonding material, the stop device 26 fractures. The expansion shell assembly 10 is then free to expand into gripping engagement with the wall of the bore hole 14. The continuous rotation of the bolt in the same initial direction completes the setting of the assembly 10. Thus the bolt is both mechanically anchored and adhesively bonded in the bore hole to prevent slippage of the expanded assembly 10 so that the bolt 12 remains tensioned to support the rock formation.

Now referring in greater detail to the structure of the expansion shell assembly 10 there is provided a shell member 28 conventional in design and including a solid ring end portion 30. The shell member 28 is expandable and has a plurality of longitudinally extending fingers 32 that extend axially from the ring end portion 30. Each of the fingers 32 has a lower end portion 34 connected to the ring end portion 30 and an upper end portion 36. Longitudinally slots 38 (only one of which is shown in FIG. 1) divide the fingers 32 from one another. Each of the slots 38 has a closed end portion 40 adjacent the ring end portion 30 and an open end portion 42 adjacent the upper end portion 36 of the respective finger 32.

Each finger 32 includes an outer gripping surface 44 and an inner smooth surface 46. The outer surface 44 includes a gripping portion 48 that extends from the finger upper end portion 36 to a position spaced from the finger lower end portion 34. The gripping portion 48 of each finger 32 includes a series of spaced parallel, tapered horizontal grooves 50. The grooves 50 form a series of downwardly extending serrations that are operable upon expansion of the shell member 28 to engage the wall of the bore hole 14 as the fingers 32 bend outwardly.

The gripping portion 38 of each finger 32 is urged into contact with the wall of the bore hole 14, as seen in FIGS. 10 and 11, by a camming plug or wedge generally designated by the numeral 52. The camming plug 52 includes a threaded axial bore 54 threadedly engaged to the bolt threaded end portion 18. The camming plug 52 has a tapered configuration with an enlarged upper end portion 56 and a reduced lower end portion 58. A portion of the inner surface 46 of each finger 32 abuts a tapered planar surface 68 of the camming plug 52.

As illustrated in FIG. 1, the camming plug 52 and the shell member 28 are maintained in assembled relation on the bolt threaded end portion 18 prior to anchoring the assembly in the bore hole 14 drilled in the mine roof. Also as well known in the art and illustrated in FIG. 6, the camming plug 52 and the shell member 28 are connected by a yieldable strap or bail 60. The bail 60 is conventional and extends across the top of the camming plug 52. The bail 60 includes leg portions 62 that extend downwardly on opposite sides of the shell member 28. The leg portions 62 are positioned in a pair of opposed slots 64. The leg portions 62 terminate in in-turned end portions 66 that extend into the slots 64 and into engagement with the inner surface 46 of the shell member 28. With this arrangement the bail 60 is engaged to the shell member 28 to maintain the camming plug 52 assembled within the shell member 28.

As illustrated in FIG. 3, the camming plug 52 includes a plurality of tapered planar surfaces 68 divided from one another by longitudinally extending grooves 70. As described above, the inner surface 46 of each finger 32 abuts a respective tapered planar surface 68. In one embodiment of the present invention the stop device 26 is positioned in a bore 72 that extends through the camming plug 52 transversely to the threaded bore 54 of the camming plug 52. As seen in FIGS. 3 and 4, the transverse bore 72 includes opposite end portions 74 that extend through the plug 52 and emerge through a pair of oppositely aligned grooves 70 of the plug 52.

Further as illustrated in FIGS. 1–4, the stop device 26 includes a shearable pin 76 fabricated of a preselected yieldable material and having a preselected size and in the case of a circular pin, a preselected diameter. The pin 76 is retained in the transverse bore 72 and includes respective end portions 78 and 80. The pin end portions 78 and 80 are retained in the bore end portions 74 of the plug 52 as illustrated in the embodiment of the stop device 26 in FIGS. 1–6. The intermediate body portion of the pin 76 extends transversely through the plug longitudinal bore 54.

The shearable pin 76 is selectively positioned to extend through the plug threaded bore 54 at a location to obstruct or prevent axial movement of the bolt threaded end portion 18 beyond a preselected depth into the camming plug bore 54. Thus upon initial assembly of the expansion shell assembly 10, the bolt threaded end portion 18 is advanced into the camming plug 52 until the bolt end portion 18 abuts the shearable pin 76 and can advance no further into the camming plug threaded bore 54.

The location of the transverse bore 72 through the camming plug 52 for positioning the shearable pin 76 is selective along the longitudinal length of the camming plug 52. To this end, as illustrated in FIG. 4, the shearable pin 76 is positioned in the camming plug transverse bore 72 at a location adjacent the plug upper end portion 56. In the embodiment of the present invention illustrated in FIG. 5, the shearable pin 76 is positioned in a plug transverse bore 82 located adjacent the plug lower end portion 58.

With the embodiment illustrated in FIG. 5 the length of the bolt threaded end portion 18 that extends into the camming plug bore 54 is less than that length when the shearable pin 76 is retained in the camming plug 52 adjacent the plug upper end portion 56. In the position of the shearable pin 76 in the camming plug 52, as illustrated in FIG. 5, the camming plug 52 is threaded on the bolt 12 to engage only several of the threads on the bolt end portion 18. The intermediate body portion of the shearable pin 76 prevents the bolt 12 from passing any further into the camming plug threaded bore 54.

The material from which the shearable pin 76 is fabricated is selective, as for example, in one embodiment the pin 76 can be fabricated of ¼ inch diameter steel; while, in another embodiment it can be fabricated of 5/16 diameter aluminum. The type of material comprising the pin 76, as well as, the dimensions and cross sectional area of the pin 76 are selective to control the shearing or fracturing of the pin depending upon the type of bonding material utilized and the period of time required for mixing of the material components. Further to ensure shearing or fracturing of the stop device 26 before the curable mixture hardens a stop device, such as a steel pin 77 illustrated in FIG. 5, is provided with deformations, such as longitudinally extending, parallel spaced grooves or recesses 84 positioned on the opposite end portions 78 and 80 of the pin 77.

The material composition and structural design of the stop device 26, such as the pins 76 and 77 illustrated in FIGS. 4 and 5, are selected in accordance with the curing time of the particular type of bonding material utilized. For example with a quick setting type of resin system which begins to harden within 20 to 30 seconds following rupture of the cartridge 24 and mixing of the components, the size and material composition of the stop device 26 are selected to permit fracture after 20 seconds of rotation of the bolt 12. Thus when the resin mixture begins to harden and apply a force upon the assembly 10 resisting rotation of the shell member 28 and plug 52, the stop device 26 fractures. Also fracture of the stop device 26 occurs when the torque applied to the bolt 12 exceeds a predetermined torque. When the stop device 26 is no longer capable of resisting the anti-rotational forces of the adhesive material applied to the rotating shell assembly 10, the stop device 26 fractures or shears. Relative rotation between the camming plug 52 and the bolt 12 is no longer prevented. The camming plug 52 is then free to move downwardly on the bolt 12 as the bolt 12 continues to rotate in the same preselected rotational direction.

The ability to control the shearing of the pin 76 provides a versatile expansion shell assembly 1 operable for use in combination with adhesive materials of varying curing characteristics, such as a quick setting-type resin curable within 20 seconds of mixing or the type of adhesive material requiring 2 to 3 minutes of mixing before hardening begins. By selecting the material composition and cross sectional area of the stop device 26 in the form of a shear pin, as well as, the location of the shear pin relative to the camming plug 52, expansion of the shell member 28 is prevented until after lapse of the time required to effect the necessary mixing of the adhesive components. Once the curable mixture is formed and begins to harden, the mixture exerts anti-rotational forces upon the camming plug 52 rotating with the bolt 18. When the shear pin is no longer capable of resisting these forces, the pin fractures freeing the bolt 18 to rotate relative to the camming plug 52. This action commences downward movement of the plug 52 and expansion of the shell 28. In addition, the entire operation is carried out by continuous rotation of the bolt 18 in the same direction. Preferably the shear pin fractures before the adhesive mixture completely solidifies or hardens so that the expandable fingers 32 are movable outwardly into gripping engagement with the wall of the bore hole 14.

A further embodiment of the shear device 26 is illustrated in FIG. 7. In this embodiment shear pin 79 is retained solely in a bore 86 extending transversely through the threaded end portion 18 of the bolt 12 adjacent the extreme end thereof. The shear pin 79 includes an intermediate portion 81 retained in the transverse bore 86 and a pair of opposite end portion 83 and 85. The pin end portions 83 and 85 extend outwardly from the bore 86 and in the assembly 10 are positioned oppositely of a pair of slots 38 between adjacent shell fingers 32. The camming plug 52 is advanced downwardly on the bolt until the lower end portion 58 of the plug 52 abuts the pin end portions 83 and 85. The pin end portions 83 and 85 abutting the camming plug 52 prevent further downward movement of the camming plug 52 on the bolt 12.

As with the above described embodiments of the stop device 26 the shearable pin 79 resists relative rotation between the bolt 12 and the camming plug 52 until a torque in excess of a predetermined torque is applied to the end of the bolt. At this torque the resistance offered by the curable bonding mixture to rotation of the plug 52 results in fracturing of the pin 79. The pin 79 is designed so that it does not fracture until the mixing of the bonding materials is complete and the mixture begins to harden. The pin end portions 83 and 85 break off from the intermediate portion 81 and are free to move through the shell slots 38.

When the torque for breaking the pin 79 is reached, the mixing is complete. The pin 79 breaks permitting downward movement of the camming plug 52 to expand the shell member 28. Expansion of the shell member 28 is delayed until the bonding material is mixed but not after the mixture rigidifies in the bore hole 14.

It should also be understood that the stop device 26 includes any suitable device that restrains axial movement of the plug 52 on the bolt 12 beyond a preselected point on the threaded end portion 18 of the bolt 12, as for example, a breakable obstruction member suitably retained in the plug threaded bore 54. The breakable member is operable to restrain relative rotation between the bolt 18 and the plug 52 until a preselected torque is applied to the bolt 18. Before the preselected torque is applied, the bonding material is mixed. When a torque in excess of the preselected torque is applied, the breakable member is displaced in the plug bore 54 to the extent permitting relative rotation between the bolt 18 and the plug 52 permitting downward movement of the plug 52 on the bolt. This results in expansion of the shell member 28 and anchoring of the assembly 10 in the bore hole 14.

The stop device 26 in another embodiment can include an obstruction which is not required to break or shear before expansion of the shell member 28 begins. This type of stop device 26 can include a flexible member, such as wire or the like, having end portions secured to the camming plug 52 and extending through the plug bore 54 obstructing the path of the rotating bolt 18. The wire abutting the end of the bolt 12 prevents downward movement of the plug 52 on the bolt 18. Movement of the plug 52 is restrained until the anti-rotational forces of the bonding mixture applied to the plug 52 result in yielding or bending of the wire permitting downward movement of the plug 52 on the bolt 12 upon continued rotation of the bolt 12. The application of the torque which results in bending of the wire corresponds to the formation of a curable bonding mixture and the initiation of expansion of the shell member 28.

Now referring to FIGS. 8–11, there is illustrated the method of anchoring the apparatus 10 and the bolt 12 in the bore hole 14 of the rock formation 16. Initially, as illustrated in FIG. 8, the resin cartridge 24 is inserted in the hole 14 drilled in the mine roof or rock formation 16 by upward advancement by the bolt 12 with the apparatus 10 attached to the threaded end portion 18 of the bolt 12. The cartridge 24 is pushed to substantially the blind end of the bore hole 14. With the cartridge 24 inserted in the upper part of the bore hole 14, as illustrated in FIG. 8, the bolt 12 is thrust upwardly to rupture of the cartridge 24.

Thereafter, the entire assembly 10 is rotated in a preselected direction as indicated by the arrow in FIG. 9 by applying a torque to the bolt enlarged end portion 20. The stop device 26 in the form of the shear pin 76 illustrated in FIGS. 8–11, fabricated of a preselected material and of a preselected size prevents relative rotation between the camming plug 52 and the bolt 12 during the initial rotation of the bolt 12 to rupture the cartridge and mix the resin components. In this manner the camming pluge 52 is restrained from moving downwardly on the bolt 12 by the bolt 12 abutting the shear pin 76 during the initial rotation of the bolt 12.

Rotation of the bolt 12 effects mixing of the resin components which are released from the cartridge 24 when the cartridge 24 is ruptured. Preferably the resin components include a thermoplastic resin and a catalyst. As the bolt 12 is rotated the resin and the catalyst are mixed to form a curable resin mixture 88. The resin mixture 88 by virtue of its thixotropic characteristics is retained within the bore hole 14. To effectively retain the volume of the mixture 88 in surrounding relation with the assembly 10 a suitable device, such as a washer 90, is retained on the bolt 12 adjacent the bolt threaded end portion 18. The washer 90 has a diameter sufficient to permit the washer to move freely in the bore hole 14 with the bolt 12 into position. In one embodiment, the washer 90 is fabricated of metal and may be either welded or press fit on the bolt 12 spaced a preselected distance below the bolt threaded portion 18. In another embodiment the washer 90 is fabricated of an elastomeric material. The elastomeric washer 90 is retained in gripping engagement on the bolt 12 below the threaded end portion 18.

The resin mixture 88 polymerizes at room temperature, i.e. a temperature in the range between about 40° and 90° F. The bolt 12 is rotated continuously in the direction indicated by the arrow in FIG. 9 to effect mixing of the resin. The shear pin 76 abutting the bolt end portion 18 prevents relative rotation between the camming plug 52 and the bolt 12. This prevents the camming plug 52 from moving downwardly on the bolt 12 until the mixing of the resin components is complete The period of time for mixing a quick setting-type resin is generally between about 20 to 30 seconds. During the mixing stage as seen in FIG. 9 the bolt 12 is held in position within the bolt hole 14 with the roof plate 22 abutting the rock formation 16 around the open end of the bolt hole 14.

The shear pin 76 by restraining downward movement of the camming plug 52 on the bolt 12 ensures complete mixing of the resin components before the shell 28 is expanded. However, due to the shear characteristics of the pin 76 designed for the resin system utilized, the shell 28 expands before the resin mixture 88 completely hardens around the shell member 28. From the time the cartridge 24 is ruptured, the bolt 12 is continuously rotated in one direction only, i.e. either clockwise or counterclockwise, to mix the resin components, as well as, expand the shell member 28. As the bolt 12 rotates the curable resin mixture 88 flows into the fissures and faults of the rock formation 16 surrounding the bore hole 14. In this well known manner, the rock strata are adhesively united to further reinforce the rock formation.

After the mixing stage, resin mixture 88 begins to cure or harden in the bore hole 14. As the resin mixture 88 begins to harden it exerts forces on the rotating shell member 28 and the camming plug 52 resisting their rotation. At a predetermined torque applied to the bolt 12, which is reached after a elapse of time to complete the mixing, the material strength of the shear pin 76 is exceeded by the anti-rotational forces exerted by the resin mixture 88 and the pin 76 fractures or shears. Consequently, the intermediate portion of the pin 76 in the plug bore 54 is broken off from the pin end portions 78 and 80 which are retained in the plug, as seen in FIG. 10. This permits the pin 76 to be displaced in the camming plug bore 54 so that the plug 52 is free to move downwardly on the bolt threaded end portion 18.

Referring to FIG. 10, downward movement of the camming plug 52 on the bolt 12, upon rotation of the bolt 12 in the same direction for forming the resin mixture 88, expands the shell member 28. The fingers 32 are bent outwardly about the shell ring end portion 30 to move the outer gripping surfaces 34 into gripping engagement with the wall of the bore hole 14. The rotation of the bolt 12 is continuous in the direction indicated by the arrows in FIGS. 9 and 10 through the resin mixing and shell expanding stages. Rotation of the bolt 12 continues until a preselected torque is applied to the bolt 12. When the preselected torque is applied, the shell member 28 is fully expanded and the gripping portions 48 of the fingers 32 are embedded in the rock formation to securely anchor the bolt 12 in the bore hole 14.

When the shell member 28 is expanded the resin mixture 88 is cured. By anchoring the bolt 12 in the bore hole 14 by the expansion shell member 28, the bolt 12 is tensioned. The addition of the cured resin in surrounding relation with the bolt 12 and the expanded shell member 28 prevents slippage of the shell member 28 in the bore hole 14. Tension on the bolt is thus maintained and is not reduced by slippage of the expanded shell member 28 in the bore hole.

By the provision of the stop device 26, the expansion shell assembly 10 is operable as a mixing tool to admix the components of the resin cartridge 24 to form the curable mixture 88 before the shell member 28 is expanded. The stop device 26 prevents downward movement of the camming plug 52 on the bolt 12 during the period in which the resin components are mixed. Also by the provision of the stop device 26, the bolt 12 is continuously rotated in the same preselected direction to effect both mixing of the resin components and expansion of the shell member 28. Thus it is not necessary with the present invention to rotate the bolt 12 in a first direction to effect mixing of the resin components and then followed by reversal of the direction of rotation of the bolt 12 to effect expansion of the shell member 28.

The provision of the stop device 26 associated with the camming plug 52 substantially improves the efficiency and ease of installation of a roof bolt that is both mechanically anchored and resin bonded within a bolt bore hole. It should also be understood even though the direction of rotation for both mixing the resin components and expanding the shell member 28 is illustrated in a counterclockwise direction in FIGS. 10 and 11, the direction of rotation can be clockwise as well depending upon whether the bolt end portion 18 is left-hand threaded or right-hand threaded.

According to the provisions of the patent statutes, I have explained the principle, preferred construction and mode of operation of my invention and have illustrated and described what I now consider to represent its best embodiments. However, it should be understood that, within the scope of the appended claims, the invention may be practiced otherwise than as specifically illustrated and described.

I claim:

1. A method of anchoring a bolt in a bore hole comprising the steps of:

threadedly engaging a camming plug to the end of the bolt for axial movement thereon, positioning an expandable shell having a plurality of longitudinally extending fingers in surrounding relation with the camming plug on the bolt, preventing axial movement of the camming plug on the bolt by a stop means associated with the bolt upon rotation of the bolt in a preselected rotational direction, preventing relative rotation between the bolt and the camming plug upon application of a predetermined torque by rotation of said bolt in the same preselected rotational direction so that the camming plug and the bolt rotate as a single unit and preventing said camming plug from rotating relative to said bolt and expanding said expandable shell, displacing the stop means by the bolt as the bolt continues to rotate in said preselected rotational direction when a torque in excess of said predetermined torque is applied to the bolt; and thereafter moving the camming plug on the bolt by rotation of said bolt in the same predetermined direction upon displacement of the stop means to expand the fingers of said expandable shell to anchor said expandable shell and said bolt connected thereto in the bore hole and applying a tension to said bolt.

2. A method of anchoring a bolt in a bore hole as set forth in claim 1 which includes, positioning a bonding material in an unmixed condition in the bore hole ahead of the expandable shell, abutting the stop means on the camming plug with the bolt to prevent rotation of the bolt relative to the camming plug, rotating the bolt in said preselected direction to effect mixing of the bonding material in the bore hole, fracturing the stop means when the mixed bonding material exerts a force resisting rotation of the camming plug with the bolt, displacing the stop means from abutting relation with the bolt, and moving the camming plug downwardly on the bolt to expand the fingers in the bore hole to anchor the bolt.

3. A method of anchoring a bolt in a bore hole as set forth in claim 1 which includes, mixing bonding material positioned in the end of the bore hole by rotation of the bolt together with the shell and the camming plug in said preselected direction, preventing rotation of the bolt relative to the camming plug by the stop means, curing of the bonding material during rotation of the bolt, displacing of the stop means relative to the camming plug upon hardening of the mixed bonding material as the bolt continues to rotate in said preselected direction, rotating the bolt in said preselected direction relative to the camming plug, and expanding the fingers of the shell in the bore hole before the bonding material hardens to anchor the bolt in the bore hole.

4. A method of anchoring a bolt in a bore hole as set forth in claim 1 which includes, obstructing downward movement of the camming plug on the bolt until the torque in excess of the predetermined torque is applied to the bolt, and displacing the stop means relative to the camming plug to permit rotation of the bolt relative to the camming plug and expansion of the shell in the bore hole.

5. A method of anchoring a bolt in a bore hole as set forth in claim 1 which includes, extending the stop means through the camming plug and abutting the bolt to prevent advancement of the camming plug on the bolt upon initial rotation of the bolt in the preselected direction.

6. A method of anchoring a bolt in a bore hole as set forth in claim 1 which includes, extending the stop means through the bolt and abutting the camming plug to prevent advancement of the camming plug on the bolt upon initial rotation of the bolt in the preselected direction.

7. A method of anchoring a bolt in a bore hole as set forth in claim 1 which includes, positioning the stop means at a preselected position on the camming plug limiting advancement of the camming plug to a preselected position on the end of the bolt.

8. A method of anchoring a bolt in a bore hole as set forth in claim 1 which includes, shearing the stop means by application of a preselected torque to the bolt to permit downward movement of the camming plug on the bolt to expand the shell in the bore hole.

* * * * *